US009505217B2

(12) United States Patent
O'Hara et al.

(10) Patent No.: US 9,505,217 B2
(45) Date of Patent: Nov. 29, 2016

(54) STORE WEB MATERIAL IN A MULTI-FOLDED STATE

(71) Applicant: HEWLETT-PACKARD DEVELOPMENT COMPANY, L.P., Houston, TX (US)

(72) Inventors: Steve A. O'Hara, Camas, WA (US); Scott Martin, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/786,929

(22) PCT Filed: Jul. 22, 2013

(86) PCT No.: PCT/US2013/051452
§ 371 (c)(1),
(2) Date: Oct. 23, 2015

(87) PCT Pub. No.: WO2015/012788
PCT Pub. Date: Jan. 29, 2015

(65) Prior Publication Data

US 2016/0193840 A1 Jul. 7, 2016

(51) Int. Cl.
*B41J 2/165* (2006.01)

(52) U.S. Cl.
CPC ..... *B41J 2/16535* (2013.01); *B41J 2/16552* (2013.01); *B41J 2002/16558* (2013.01)

(58) Field of Classification Search
None
See application file for complete search history.

(56) References Cited

U.S. PATENT DOCUMENTS

| | | | | |
|---|---|---|---|---|
| 6,692,100 | B2 | 2/2004 | Steinfield et al. | |
| 6,949,060 | B2 | 9/2005 | Lenk | |
| 7,731,328 | B2 | 6/2010 | Jung et al. | |
| 7,770,518 | B2 | 8/2010 | Barinaga et al. | |
| 8,444,251 | B2 | 5/2013 | Heo et al. | |
| 2006/0209122 | A1* | 9/2006 | Barinaga | B41J 2/16535 347/33 |
| 2010/0177141 | A1 | 7/2010 | Hendricks et al. | |
| 2011/0043567 | A1 | 2/2011 | Jung et al. | |
| 2012/0026241 | A1 | 2/2012 | Gaston et al. | |
| 2012/0218346 | A1 | 8/2012 | Inoue | |

FOREIGN PATENT DOCUMENTS

| | | | |
|---|---|---|---|
| JP | 2003033712 | A | 2/2003 |
| JP | 2009286077 | A | 12/2009 |

OTHER PUBLICATIONS

Boesen, M.; "Cleaning Canon Print Heads on a Canon I865, Ip4000, Ip4200 and Some Other Canon Pixma Printers"; Sep. 17, 2012; (continued from above) http://mboesen.net/hardware/print_heads/print_heads.html.

International Searching Authority, The International Search Report and the Written Opinion dated Apr. 22, 2014 for PCT/US2013/051452 filed Jul. 22, 2013, 10 Pages.

* cited by examiner

*Primary Examiner* — Lisa M Solomon
(74) *Attorney, Agent, or Firm* — HP Inc. Patent Department

(57) ABSTRACT

A method, a wiping apparatus, and a wiping system to store web material in a multi-folded state in a web storage chamber.

15 Claims, 6 Drawing Sheets

STORE WEB MATERIAL IN A MULTI-FOLDED STATE

BACKGROUND

A wiping apparatus may include a web storage chamber and web material stored therein. During a service event, the web material may be placed in contact with and wipe a fluid applicator. The wiping operation may maintain a health of the fluid applicator.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

A wiping apparatus may include a web storage chamber and web material stored therein. During a service event, the web material may be placed in contact with and wipe a fluid applicator such as a page-wide, inkjet printhead array. The wiping operation may maintain a health of the fluid applicator. During the wiping operation, the web material may remove residue and/or debris from a surface of the fluid applicator. The wiping operations may require a substantial amount of web material to be partially consumed with a limited number of reuses possible before the web material loses its effectiveness. That is, the amount of times that the same portion of the web material may be used to effectively absorb the residue and/or debris from the surface of the fluid applicator is limited. Additionally, a chamber to store the web material typically lacks enough available space to store a desired length of the web material. Thus, the stored amount of web material may be less than desired. Accordingly, image quality defects, fluid applicator defects, and/or a number of times the wiping apparatus may need to be replaced are increased.

In examples, a method of operating a wiping apparatus includes storing a web material including a plurality of segment portions in a multi-folded state. For example, each one of a plurality of folds of the web material may be placed between adjacent segment portions in a web storage chamber of the wiping apparatus. The web storage chamber may include an input opening and an output opening. The method also includes transporting the web material in the web storage chamber through a plurality of choking stages in which a folding density of the web material is reduced as it is transported from a choking stage to a subsequent choking stage. For example, the folding density of the web material corresponds to a number of folds per amount of web material. Thus, a sufficient amount of web material may be compressed and stored in a minimal amount of space in the web storage chamber. Further, the web material may be extracted from the web storage chamber free of folds and major creases. Accordingly, a desired amount of web material may be effectively stored and extracted from the web storage chamber. Consequently, image quality defects, fluid applicator defects, and/or a number of times the wiping apparatus may need to be replaced are decreased.

Figure 1:
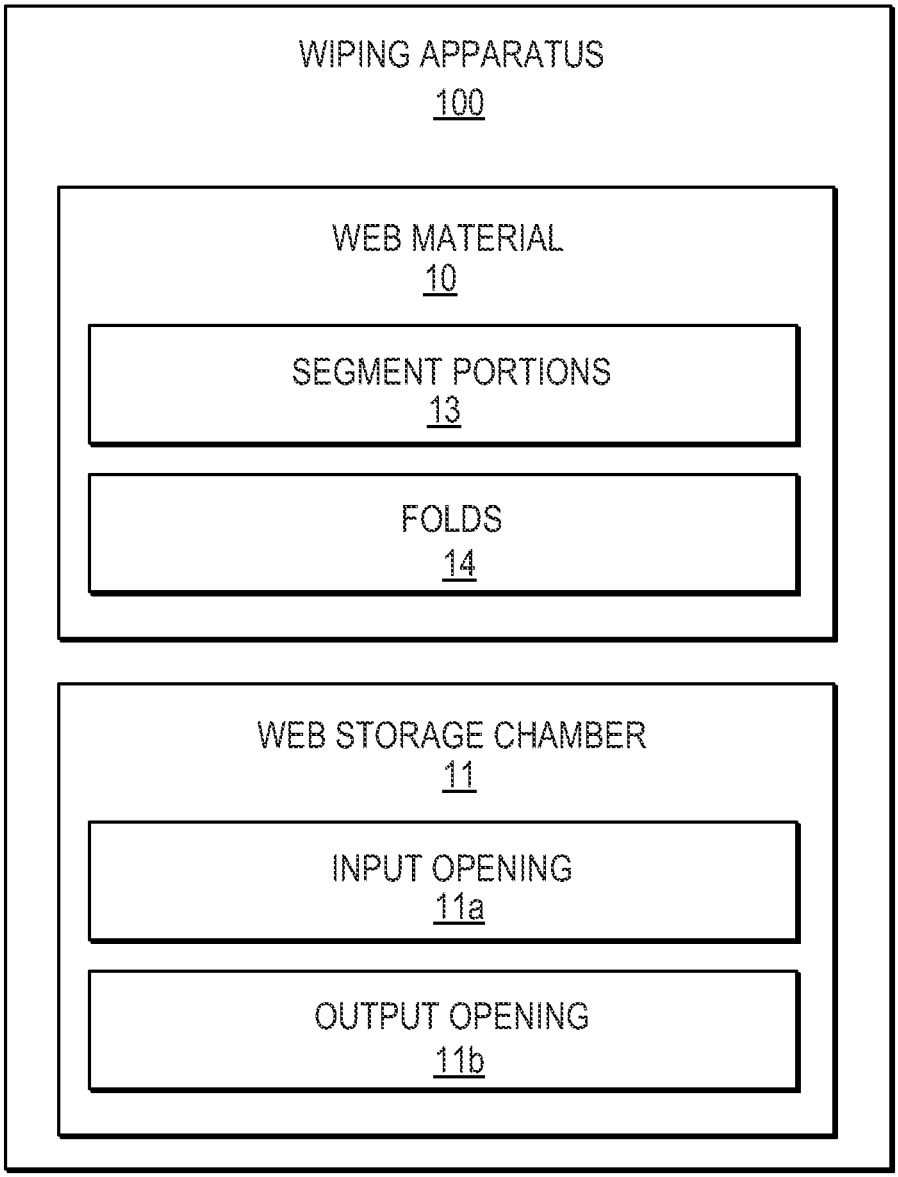
FIG. 1 is a block diagram illustrating a wiping apparatus according to an example.

FIG. 1 is a block diagram illustrating a wiping apparatus according to an example. The wiping apparatus 100 may be usable with a fluid applicator. In some examples, the fluid applicator may include a printhead, a plurality of printhead modules, a print bar, and/or a printhead assembly, and the like. For example, in an inkjet printhead, a printing fluid may be ejected from respective nozzles. Referring to FIG. 1, in some examples, the wiping apparatus 100 may include a web material 10 and a web storage chamber 11. The web material 10 may include a plurality of segment portions 13 to wipe the fluid applicator. The web material 10 may also include pores and absorbent properties. Thus, during a wiping operation, the respective segment portions 13 of the web material 10 in contact with a surface of the fluid applicator may absorb and remove residue and/or debris there from.

Referring to FIG. 1, in some examples, the web storage chamber 11 may include an input opening 11*a* and an output opening 11*b*. The web storage chamber 11 may store the web material 10 in a multi-folded state. The multi-folded state of the web material 10 may correspond to the web material 10 having a plurality of folds 14 and each one of the folds 14 is placed between adjacent segment portions 13. In some examples, each one of a plurality of folds 14 of the web material 10 may be placed between adjacent segment portions 13 and exterior surfaces of the adjacent segment portions 13 may contact each other.

Figure 2:
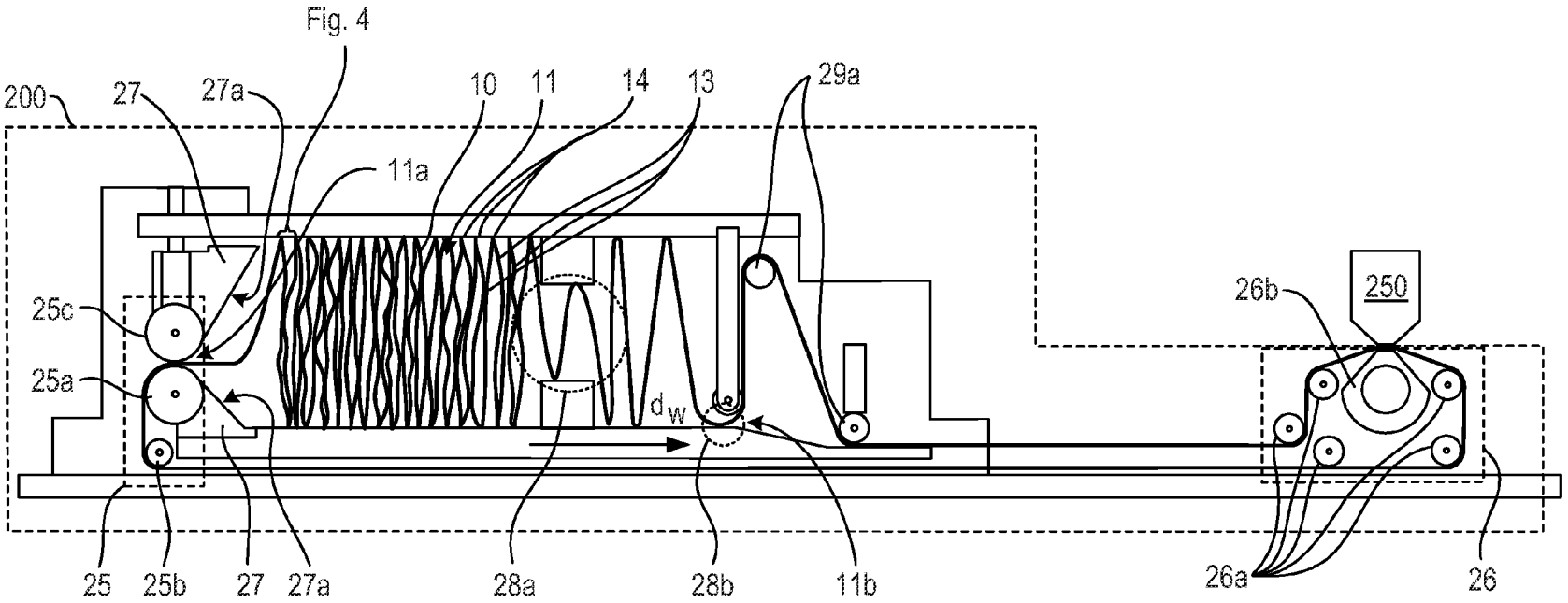
FIG. 2 is a schematic view illustrating a wiping apparatus according to an example.
Figure 3:
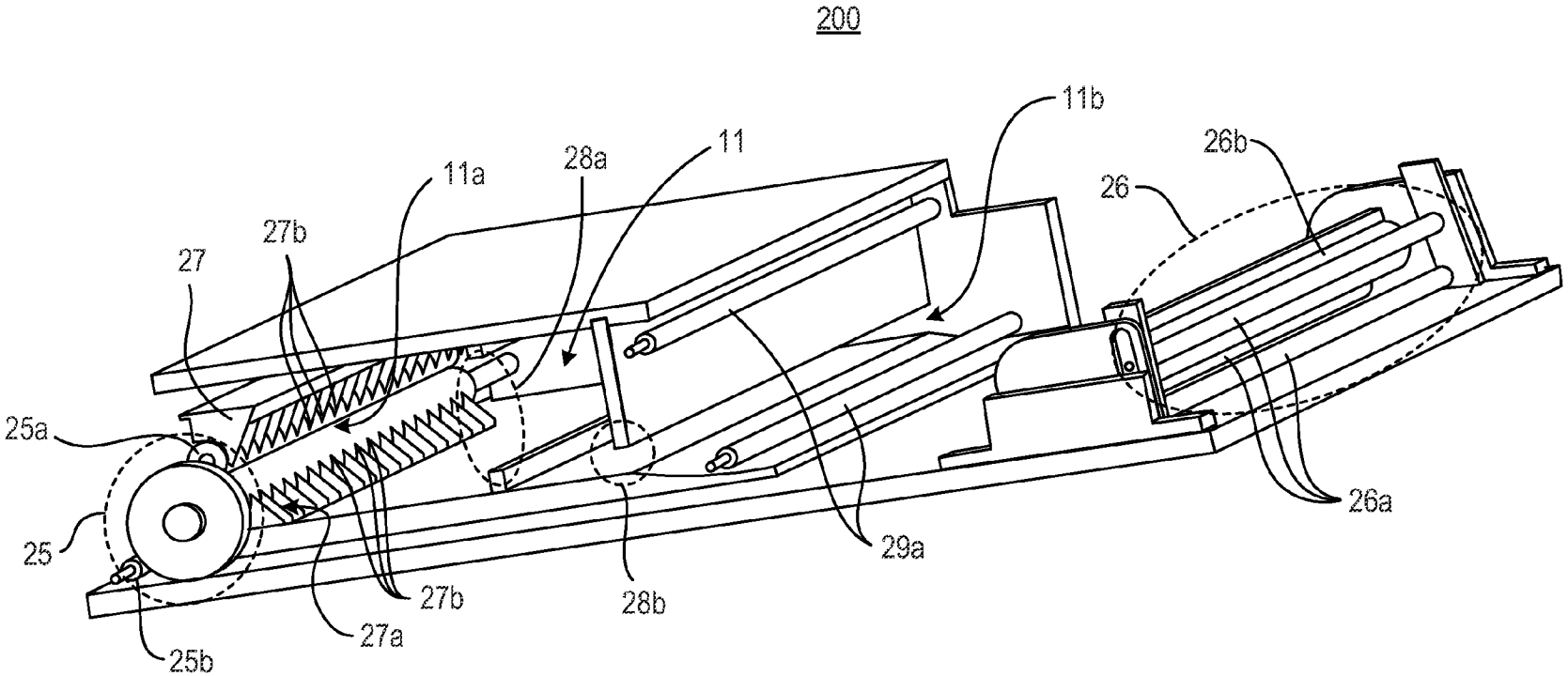
FIG. 3 is a perspective view illustrating the wiping apparatus of FIG. 2 according to an example.

FIG. 2 is a schematic view illustrating a wiping apparatus according to an example. FIG. 3 is a perspective view illustrating the wiping apparatus of FIG. 2 according to an example. For purposes of illustration, the web material is not depicted in FIG. 3. The wiping apparatus 200 may be usable with a fluid applicator 250. Referring to FIGS. 2-3, in some examples, the wiping apparatus 200 may include the web material 10 and the web storage chamber 11 as previously discussed with respect to the wiping apparatus 100 of FIG. 1. In some examples, the wiping apparatus 200 may also include a web input device 25, a web output device 26, and supplemental rollers 29.

Referring to FIGS. 2-3, in some examples, the web input device 25 may include a drive roller 25*a*, a companion roller 25*c*, and an input guide roller 25*b*. The driver roller 25*a* may sequentially place the plurality of segment portions 13 of the web material 10 into the web storage chamber 11 through the input opening 11*a*. For example, the drive roller 25*a* may push the web material 10 through the input opening 11*a* and into the web storage chamber 11 in a web transport direction $d_w$. The companion roller 25*c* may be disposed across from the driver roller 25*a* and engage the web material 10 in cooperation with the drive roller 25*a*. The input guide roller 25*b* may guide the web material 10 to the drive roller 25*a*.

Referring to FIGS. 2-3, in some examples, the web output device 26 may include a plurality of rollers 26*a* and a web applicator 26*b*. The plurality of rollers 26*a* may sequentially receive the plurality of segment portions 13 of the web material 10 from the web storage chamber 11. At least some of the rollers 26*a* may sequentially place the plurality of segment portions 13 in contact with the fluid applicator 250 to selectively perform a wiping operation there with. In some examples, the web output device 26 may receive a predetermined amount of the web material 10 to be provided to the fluid applicator 250. The web output device 26 may also sequentially transport the segment portions 13 back to the web input device 25, for example, to be stored for reuse to perform the wiping operation. In some examples, the web material 10 may be in a form of a continuous loop. Additionally, in some examples, the fluid applicator 250 may be a page-wide, inkjet printhead array to eject printing fluid there from.

Referring to FIGS. 2-3, in some examples, the supplemental rollers 29 may receive the web material 10 from the output opening 11*b* of the web storage chamber 11. The supplemental rollers 29*a* may guide the web material 10 to the output device 26. In some examples, the supplemental rollers 29 may extend a path of the web material 10 and provide additional tension in order to reduce creases and/or folds thereto.

Referring to FIGS. 2-3, in some examples, the web storage chamber 11 may also include a plurality of anti-catch guards 27, and a plurality of choking stages 28*a* and 28*b* (collectively 28). The anti-catch guards 27 may be disposed proximate to the input opening 11*a* to direct the plurality of segment portions 13 received from the web input device 25 such as a driver roller 25*a* away from the input opening 11*a*. The anti-catch guards 27 may prevent the web material 10 inside the web storage chamber 11 from backing up onto the drive roller 25*a* and direct it away there from based on pressure continually being placed on the web material 10 to transport it through the input opening 11*a* and into the web storage chamber 11. In some examples, the anti-catch guards 27 may be disposed adjacent to the web input device 25 and/or input opening 11*a*, and include a slanted surface 27*a* having a plurality of ridges 27*b*. Each one of the choking stages 28*a* and 28*b* may include at least one choking member and/or a choking surface on and/or extending from a top, a bottom, or sides of the web storage chamber 11, and the like.

Referring to FIGS. 2-3, in some examples, the web material 10 progresses through the choking stages 28*a* and 28*b* within the web storage chamber 11, for example, in a web transport direction $d_w$. The choking stages 28*a* and 28*b* may provide sufficient compression to efficiently store the web material 10 in the multi-folded state and reduce an ability of the segment portions 13 to bind on each other and/or a surface of the web storage chamber 11. The choking stages 28*a* and 28*b* may also provide sufficient compression to the web material 10 to be effectively extracted from the web storage chamber 11. Thus, in some examples, application of sufficient compression, decompression, and packing of the web material 10, assists in increasing the amount of web material 10 to be stored in the web storage chamber 11, while reducing an amount of folds or loops in the web material 10 extracted there from. For example, the wiping apparatus 200 may be balanced with respect to a predetermined quantity of web material 10 such that the friction created by packing the web material 10 into the web storage chamber 11 may be balanced by the design of the respective choking stages 28*a* and 28*b* to allow the web material 10 to come out an end of the web storage chamber 11 with practically no or a reduced amount of loops or folds.

Referring to FIGS. 2-3, in some examples, a folding density of the web material 10 may be reduced as the web material 10 passes through respective choke stages 28*a* and 28*b*. For example, the folding density may progressively decrease as the web material 10 passes through respective choking stages. The folding density of the web material 10 may correspond to a number of folds 14 per amount of web material 10. For example, the amount of web material 10 may include a length of the web material 10 and the number of folds 14 per length of web material 10 may be reduced after it passes by each one of the respective choking stages.

That is, the folding density of the web material 10 in a region before a first choking stage 28*a* may be greater than the folding density of the web material 10 in a region downstream of the first choking stage 28*a* and upstream of the second choking stage 28*b*. Additionally, the folding density of the web material 10 in the region downstream of the first choking stage 28*a* and upstream of the second choking stage 28*b* may be greater than the folding density of the web material 10 in a region downstream of the second choking stage 28*b*. Progressively decreasing the folding density of the web material 10 within the web storage chamber 11 and prior to it leaving (e.g., upstream of) the output opening 11*b* thereof may enable individual segment portions 13 of uniform web material to be accurately extracted there from with minimal force and ready to be applied to the fluid applicator 250.

Figure 4:
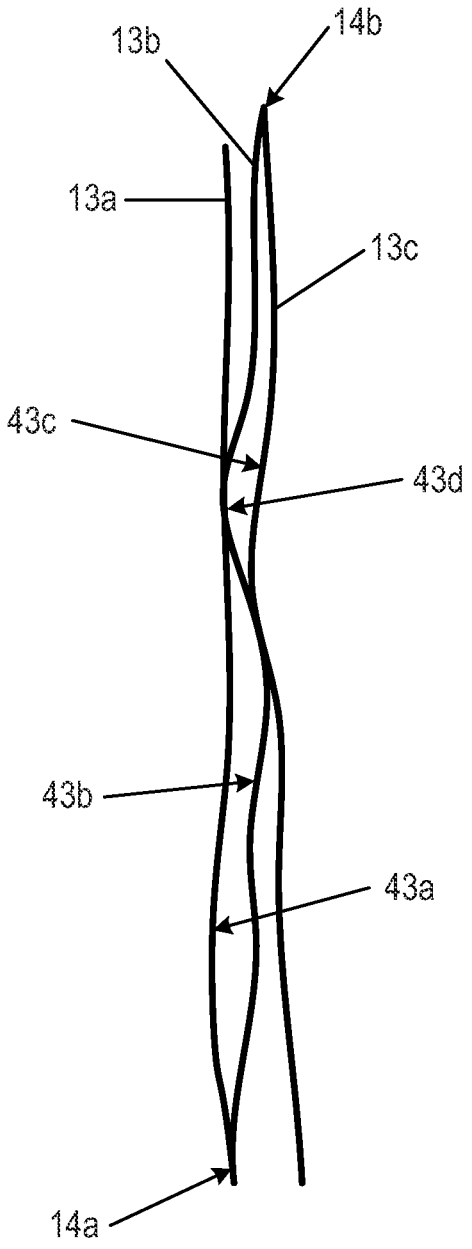
FIG. 4 is an exploded view illustrating a portion of the web material of the wiping apparatus of FIG. 2 according to an example.

FIG. 4 is an exploded view illustrating a portion of the web material of the wiping apparatus of FIG. 2 according to an example. Referring to FIG. 4, in some examples, the multi-folded state of the web material 10 corresponds to each one of a plurality of folds 14*a* and 14*b* (collectively 14) of the web material 10 placed between adjacent segment portions 13*a*, 13*b* and 13*c* (collectively 13). Additionally, in some examples, a respective fold may be created by a portion of the web material 10 being folded onto itself. That is, an exterior surface 43*a* of one segment portion 13*a* of the web material 10 may be configured to be disposed opposite and proximate to an exterior surface 43*b* of an adjacent segment portion 13*b* of the web material 10.

In some examples, an exterior surface 43*a* of a respective segment portion 13*a* is configured to contact an exterior surface 43*b* of a respective adjacent segment portion 13*b* for each of the plurality of segment portions 13. For example, the web material 10 in the multi-folded state may include a plurality of folds 14*a* and 14*b* in which respective exterior surfaces 43*a*, 43*b*, 43*c*, and 43*d* of adjacent segment portions 13*a*, 13*b*, and 13*c* may contact each other.

Figure 5:
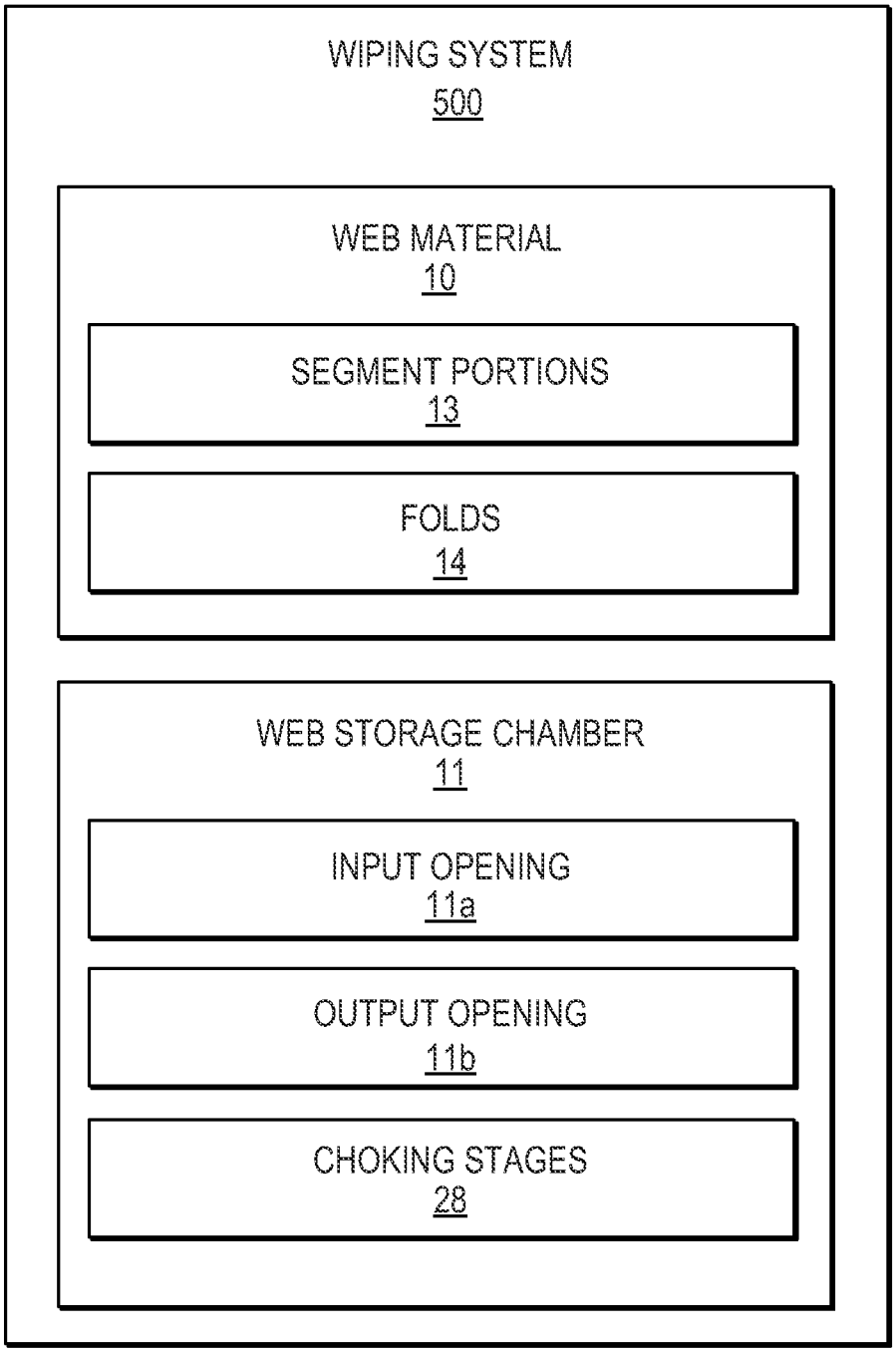
FIG. 5 is a block diagram illustrating a wiping system according to an example.

FIG. 5 is a block diagram illustrating a wiping system according to an example. The wiping system 500 may be usable with a fluid applicator. Referring to FIG. 5, in some examples, the wiping system 500 may include a web material 10 and a web storage chamber 11. The web material 10 may include a plurality of segment portions 13 to wipe the fluid applicator. The web storage chamber 11 may include an input opening 11*a*, an output opening 11*b*, and a plurality of choking stages 28*a* and 28*b* (collectively 28). Note there are other choke features on the sides 90 degrees to 28A. The web storage chamber 11 may store the web material 10 in a multi-folded state such that each one of a plurality of folds 14 of the web material 10 is placed between adjacent segment portions 13 in the web storage chamber 11. Each choking stage 28*a* and 28*b* may decrease a folding density of the web material 10 as it passes through respective choking stages. The folding density of the web material 10 may correspond to a number of folds per amount of web material 10.

Figure 6:
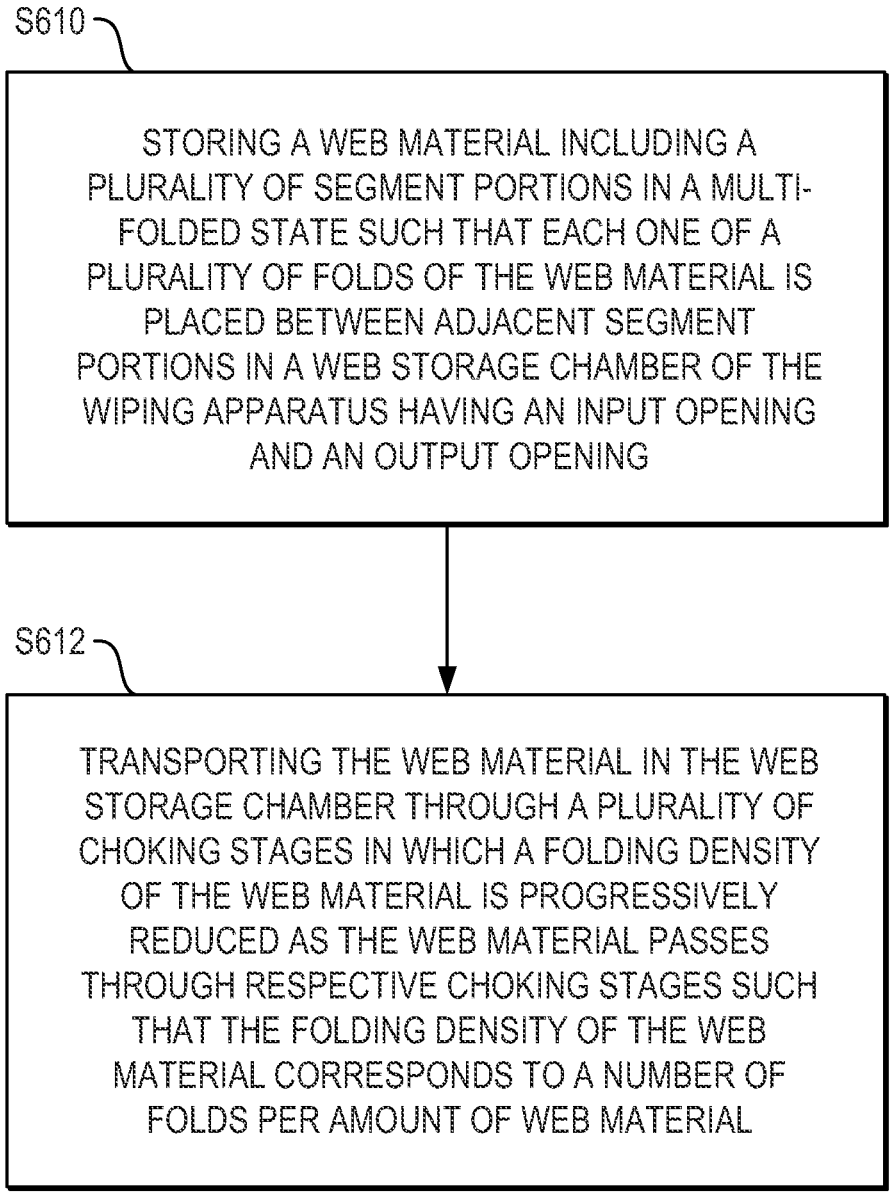
FIG. 6 is a flowchart illustrating a method of operating a wiping apparatus according to an example.

FIG. 6 is a flowchart illustrating a method of operating a wiping apparatus according to an example. Referring to FIG. 6, in block S610, a web material including a plurality of segment portions is placed in a multi-folded state such that each one of a plurality of folds of the web material is placed between adjacent segment portions and is stored in a web storage chamber of the wiping apparatus having an input opening and an output opening. For example, an exterior surface of one segment portion may be placed in contact with an exterior surface of an adjacent segment portion for each one of the plurality of segment portions. In block S612, the web material in the web storage chamber is transported through a plurality of choking stages in which a folding density of the web material is progressively reduced as the web material passes through respective choking stages such that the folding density of the web material corresponds to a number of folds per amount of web material.

In some examples, the method may also include sequentially receiving the plurality of segment portions of the web material from the web storage chamber by a web output device. Additionally, the method may also include sequentially placing the plurality of segment portions in contact with the fluid applicator by the web output device to selectively perform a wiping operation there with. In some examples, the method may also include sequentially placing the plurality of segment portions of the web material into the web storage chamber through the input opening by a web input device. Additionally, the method may also include sequentially transporting the segment portions of the web material in a form of a continuous loop back to the web input device by the web output device.

It is to be understood that the flowchart of FIG. 6 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 6 illustrates a specific order of execution, the order of execution may differ from that which is depicted. For example, the order of execution of two or more blocks may be rearranged relative to the order illustrated. Also, two or more blocks illustrated in succession in FIG. 6 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A wiping apparatus usable with a fluid applicator, the wiping apparatus comprising:

a web material including a plurality of segment portions to wipe the fluid applicator; and a web storage chamber having an input opening and an output opening, the web storage chamber to store the web material in a multi-folded state such that each one of a plurality of folds of the web material is placed between adjacent segment portions and exterior surfaces of the adjacent segment portions contact each other.

2. The wiping apparatus of claim 1, further comprising:

a web input device to sequentially place the plurality of segment portions of the web material into the web storage chamber through the input opening.

3. The wiping apparatus of claim 2, wherein the web input device comprises:

a driver roller to sequentially place the plurality of segment portions into the web storage chamber through the input opening thereof.

4. The wiping apparatus of claim 2, wherein the web storage chamber further comprises:

a plurality of anti-catch guards disposed proximate to the input opening to direct the plurality of segment portions received from the web input device away from the input opening.

5. The wiping apparatus of claim 1, wherein the web storage chamber further comprises:

a plurality of choking stages, each choking stage to reduce an ability of the segment portions from binding on at least one of each other and a surface of the web storage chamber.

6. The wiping apparatus of claim 1, wherein a folding density of the web material is reduced as the web material passes through respective choking stages such that the folding density of the web material corresponds to a number of folds per amount of web material.

7. The wiping apparatus of claim 1, further comprising:

a web output device to sequentially receive the plurality of segment portions of the web material from the web storage chamber and sequentially place the plurality of segment portions in contact with the fluid applicator to selectively perform a wiping operation there with.

8. The wiping apparatus of claim 7, wherein the web output device comprises:

a plurality of rollers configured to sequentially transport the segment portions back to the web input device; and a web applicator to press respective segment portions of the web material against the fluid applicator to perform the wiping operation.

9. The wiping apparatus of claim 1, wherein the web material is in a form of a continuous loop.

10. The wiping apparatus of claim 1, wherein the fluid applicator is a page-wide, inkjet printhead array to eject printing fluid there from.

11. A wiping system usable with a fluid applicator, the wiping system comprising:

a web material including a plurality of segment portions to wipe the fluid applicator; and a web storage chamber including an input opening, an output opening, and a plurality of choking stages, the web storage chamber to store the web material in a multi-folded state such that each one of a plurality of folds of the web material is placed between adjacent segment portions in the web storage chamber;

each choking stage to decrease a folding density of the web material as the web material passes there through; and wherein the folding density of the web material corresponds to a number of folds per amount of web material.

12. A method of operating a wiping apparatus, the method comprising:

storing a web material including a plurality of segment portions in a multi-folded state such that each one of a plurality of folds of the web material is placed between adjacent segment portions in a web storage chamber of the wiping apparatus having an input opening and an output opening; and transporting the web material in the web storage chamber through a plurality of choking stages in which a folding density of the web material is progressively reduced as the web material passes through each choking stage such that the folding density of the web material corresponds to a number of folds per amount of web material.

13. The method according to claim 12, wherein the storing a web material including a plurality of segment portions in a multi-folded state further comprises:

placing an exterior surface of one segment portion in contact with an exterior surface of an adjacent segment portion for each one of the plurality of segment portions.

14. The method of claim 12, further comprising:

sequentially receiving the plurality of segment portions of the web material from the web storage chamber by a web output device; and sequentially placing the plurality of segment portions in contact with the fluid applicator by the web output device to selectively perform a wiping operation there with.

15. The method of claim 14, further comprising:

sequentially placing the plurality of segment portions of the web material into the web storage chamber through the input opening by a web input device; and sequentially transporting the segment portions of the web material in a form of a continuous loop back to the web input device by the web output device.

* * * * *